US006939442B2

(12) United States Patent
Klimpl et al.

(10) Patent No.: US 6,939,442 B2
(45) Date of Patent: Sep. 6, 2005

(54) ANTIMICROBIAL PAPER

(75) Inventors: Fred Klimpl, Great Neck, NY (US); Ken Sonenberg, Great Neck, NY (US)

(73) Assignee: SilverCo LLC, Great Neck, NY (US)

( * ) Notice: Subject to any disclaimer, the term of this patent is extended or adjusted under 35 U.S.C. 154(b) by 0 days.

(21) Appl. No.: 10/610,505

(22) Filed: Jun. 27, 2003

(65) Prior Publication Data

US 2004/0149409 A1 Aug. 5, 2004

Related U.S. Application Data

(60) Provisional application No. 60/433,898, filed on Jan. 21, 2003.

(51) Int. Cl.[7] ..... D21H 21/36
(52) U.S. Cl. ..... 162/161; 162/158
(58) Field of Search ..... 162/161, 158; 424/414, 415; 422/8

(56) References Cited

U.S. PATENT DOCUMENTS

| | | | | |
|---|---|---|---|---|
| 2,833,669 A | | 5/1958 | Hans Klenk | |
| 3,560,332 A | * | 2/1971 | Crandall et al. | 162/161 |
| 4,533,435 A | | 8/1985 | Intili | |
| 6,645,642 B2 | | 11/2003 | Kulkarni et al. | |

* cited by examiner

*Primary Examiner*—Peter Chin
(74) *Attorney, Agent, or Firm*—Jeffrey Kaden; Gottlieb, Rackman & Reisman, P.C.

(57) ABSTRACT

A conventional paper product used for printing or for fabrication into envelopes, file folders, forms and the like, is prepared by having antimicrobial agents added into the sizing during the manufacturing process. The antimicrobial agent provides protection to the paper from fungi, mildew and bacteria that could otherwise destroy the paper or be harmful to the user thereof.

9 Claims, 1 Drawing Sheet

ANTIMICROBIAL PAPER

This application claims priority of provisional patent application Ser. No. 60/433,898, filed Jan. 21, 2003.

BACKGROUND OF THE INVENTION

In general, antimicrobial chemicals have been used for years to preserve plastics and textile materials. Furthermore, the prior art teaches the use of antimicrobials in pulp and paper manufacture. In some instances, the antimicrobial chemicals are applied as slime control agents and in the paper production. However, these slime control agents are normally extracted during the paper manufacturing process and are not considered to be of any value in protecting the finished paper.

The production of antimicrobial paper has most often accomplished by producing the desired paper in sheet form and coating the sheet with an antimicrobial coating in order to inhibit growth of fungi and bacteria thereon. For example, U.S. Pat. No. 2,833,669 is directed to a cellulosic product, the type used for medical, industrial, hygienic, and other similar purposes. This patent discloses the use of a bactericidal coating having a particular affinity for fiber substances. In particular, the patent teaches spreading the bactericidal coating across the paper product just before the fibrous web has been subjected to a drying process as part of the overall paper manufacture. The patent further discloses that the bactericidal layer may be applied to one or both sides of the web. The problem inherent in this type of process is the fact that the bactericidal coating may be easily rubbed off or otherwise destroyed, for example, during storage or shipping. Once the coating has been destroyed, there is no further antimicrobial or anti-bacterial material along the paper product for inhibiting micro-organism growth.

U.S. Pat. No. 4,533,435 teaches incorporating an antimicrobial additive into the binding agent of a heavy duty paper product. The antimicrobial additive thus migrates from within the binding agent onto the paper fibers in order to significantly eliminate the growth of micro-organisms thereon. Particularly, the antimicrobial additive described in U.S. Pat. No. 4,533,435 is chosen to be compatible with the binder material such that it resides in a colloidal suspension within the amorphous zones of the polymeric material which makes up the binder rather than being cross-linked with the polymeric material. Nonetheless, despite the improvements provided by this patent, the teaching of this patent is less than desirable because a substantial amount of antimicrobial chemical must be used in order for a sufficient amount of antimicrobial to be present along the surface of the paper.

Another problem with respect to prior art antimicrobial paper products is that it is necessary to incorporate large quantities of antimicrobial chemicals into the pulp. As a result, the paper manufacturing process becomes significantly uneconomical. In addition, if the antimicrobial chemicals are introduced at the wet end of the paper making process, they may be introduced into the waterway stream and thus contaminate rivers or water sheds, lakes, streams and even cause damage to wildlife as well as plant life. Thus, additional water treatment facilities may be necessary in order to neutralize the chemicals, thereby increasing the cost in the manufacturing process.

SUMMARY OF THE INVENTION

Generally speaking, in accordance with the invention, conventional paper used for printing or for fabrication into envelopes, file folders, forms and the like, is prepared by having antimicrobial agents added into the sizing during the manufacturing process. The antimicrobial agent provides protection to the paper from fungi, mildew and bacteria that could otherwise destroy the paper or be harmful to the user thereof. Particularly, the antimicrobial agent will be suitable for actively attacking various microbes, including bacteria as well as viruses, that could use conventional paper as "food" for growth and multiplication. The incorporated antimicrobial agents will also kill bacteria, viruses, fungi and mildew, thus providing protection to those persons handling the paper product, in whatever form it may be prepared.

Significantly, in manufacture, a sizing mixture is used in preparing the paper product; the mixture contains both antimicrobial agents and sizing, as well as water. The ratio of antimicrobial chemicals to sizing is between about 0.1:100 and 1.0:100. These agents may be selected form organic antimicrobial chemicals, such as phenols, for example, Triclosan, organic silanes, as well as inorganic antimicrobial chemicals such as silver ion zeolites and silanes.

Accordingly, it is an object of the invention to provide an improved antimicrobial paper product.

Still another object of the invention is to provide an improved antimicrobial paper product in which the antimicrobials are incorporated into the sizing during the manufacturing process.

Yet another object of the invention is to provide an improved antimicrobial paper product having an enhanced effectiveness.

Still other objects and advantages of the invention will become obvious in view of the following detailed description.

BRIEF DESCRIPTION OF THE DRAWINGS

For a fuller understanding of the invention, reference is made to the following description, taken in connection with the accompanying drawings, in which.

DETAILED DESCRIPTION

Figure 1:
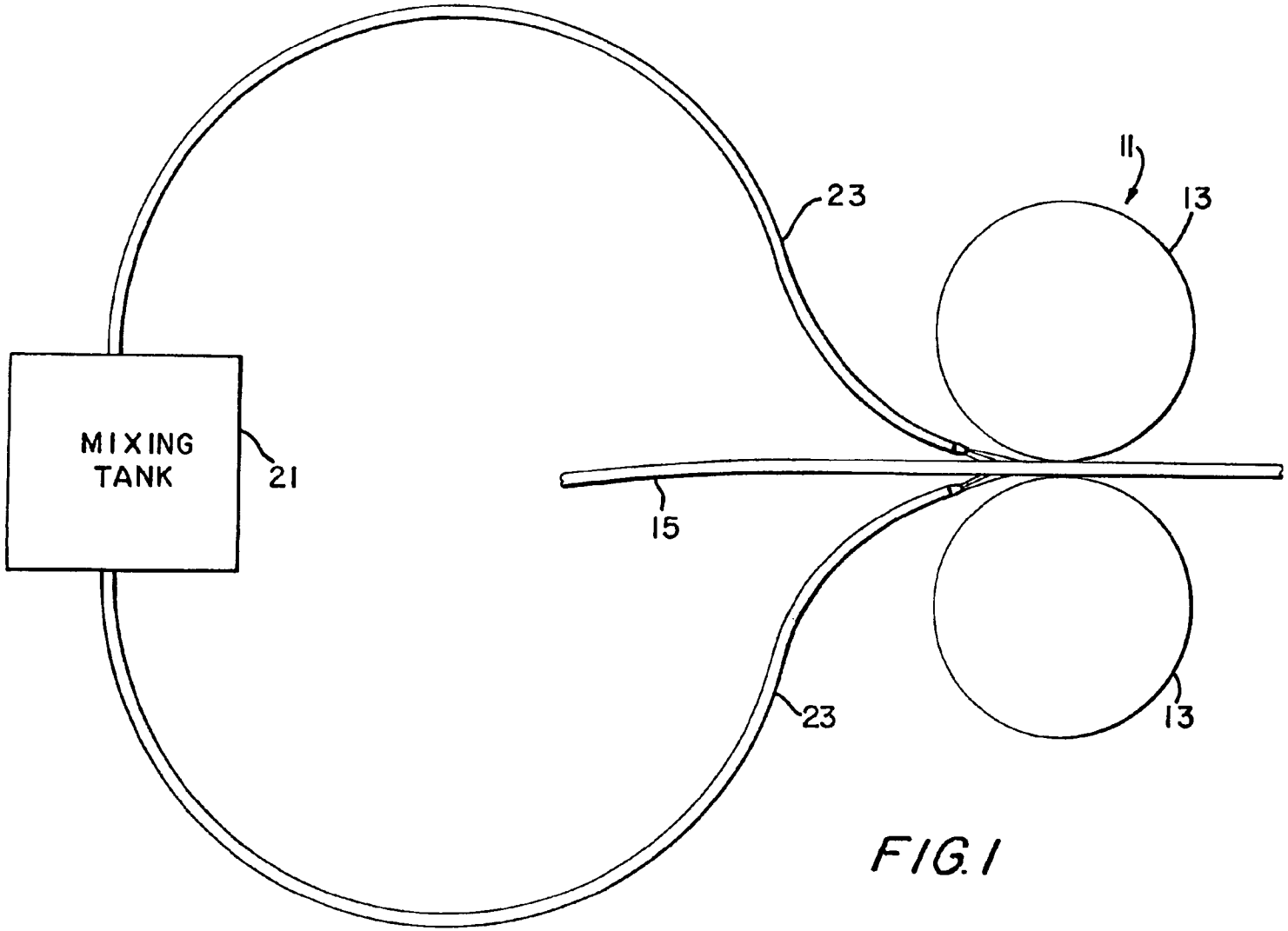
FIG. 1 is a front elevational view of a size press installation system used in the manufacture of the antimicrobial paper product of the invention.

The antimicrobial paper product of the invention may be used for various types of applications, for example, for paper intended for printing forms, such as forms for medical and dental offices, that must be suitable for lithography as well as copying with laser and ink jet printers; the antimicrobial paper may also be used for heavier grades of folder type paper, commonly referred to as "manila."

In accordance with the invention, the paper product is produced by first forming the paper from a pulp slurry. In particular, water is extracted from the pulp by, for example, vacuum, pressure and/or heat, as is well known, thus forming a paper web comprising paper fibers having interstices which, while still somewhat damp, passes through a machine called a size press 11 of the type known to those skilled in the art and depicted generally in FIG. 1. The size press is comprised typically of two squeeze rollers 13 between which the paper web 15 is passed. As part of the process, a sizing material or mixture, which is composed primarily of sizing and water, is dispensed, for example, through hoses 23 emanating from one or more mixing tanks 21 and directed between the nips of the squeeze rollers. The squeeze rollers normally have a gap between them that defines the thickness of the paper web. Thus, by setting the gap to a size equal to or smaller as compared to the thickness of the paper web, the sizing mixture is thus forced into the interstices of the paper fibers.

The use of a sizing mixture in the paper manufacturing process is significant in that, when the paper web is dried, the sizing mixture adds surface characteristics such as printability, durability, wet or dry strength, smoothness, brightness, and other well know characteristics. In general, the amount of sizing that is utilized when dispensing the sizing mixture in accordance with the inventive process ranges from between about 20 to 100 lbs. per ton of produced paper (after drying).

In order to prepare the sizing mixture, a mixing tank with a propeller type blade may be used, as is alluded to above. Water is introduced and then sizing is added to the mixture along with antimicrobial chemicals. The amount of water is selected so that the resulting sizing mixture is suitable for flow to and ultimate deposition on the paper web, as described hereinafter. The sizing is selected from soaps, animal glues, starch paste, synthetic glues, latex products and combinations thereof. Mixing is complete in about twenty minutes utilizing a water temperature range of between about 70° to 200° Fahrenheit. Application temperature of the sizing mixture during the paper manufacturing process should be at a temperature range of between about 70°–180° Fahrenheit.

Turning once again to the paper manufacturing process, the size press passes the prepared sizing mixture into the interstices of the paper fibers from either one or both sides of the paper web, depending upon whether antimicrobial protection is desired along both sides of the finished paper product. Penetration and distribution of the antimicrobial chemicals is thus achieved throughout a substantial portion of the thickness of the paper. The ratio of antimicrobial chemicals to sizing in the sizing mixture is from between 0.1:100 and 1:100 and the amount of sizing to be ultimately deposited on the paper web is in the range of between 20 and 100 pounds per ton of produced paper. This achieves the application of antimicrobial chemicals of between about 0.02 and 1 pound per ton of paper.

It is important to note that the particulate antimicrobial chemicals that are selected for incorporation within the sizing mixture usually have a particle size of about three microns or less. Therefore, the antimicrobial chemicals are easily carried into the interstices of the paper fibers, with the pressure of the squeeze rollers pressing the sizing mixture into the paper. Accordingly, an integrated coating of the antimicrobial chemicals is achieved across the paper fibers during the manufacturing process.

Suitable antimicrobial chemicals to be added to the sizing mixture in accordance with the inventive system include particulate organic antimicrobial agents including phenols, such as Triclosan, which is 5-chloro-2-(2,4-dichlorophenoxy) phenol, supplied by Ciba Specialty Chemical Corporation of Tarrytown, N.Y., and liquid antimicrobial agents including organic silanes such as 3-(trimethoxysilyl) propyldimethyloctadecyl ammonium chloride (an organic quaternary ammonium salt compound) and chloropropyltrimethoxysilane. Other organic quaternary ammonium salts (particulate or liquid form), such as dialkyl dimethyl ammonium chloride, alkyldimethyl ethylbenzyl ammonium chloride and alkyldimethyl benzyl ammonium chloride, as well as those of the type identified in U.S. Pat. Nos. 5,049,383, 4,444,790 and 4,450,174, incorporated herein by reference, may also be used. Phenol antimicrobials are particularly effective in inhibiting or killing both gram-positive and gram-negative bacteria and are also effective in inhibiting the growth of mold and mildew. Inorganic particulate antimicrobial agents can also be used, such as silver zeolites, namely, Irgaguard B5000, which is a combination of zinc oxide and DHT-4A-2 and AgZn zeolite II), Irgaguard B8000, which is AgZn zeolite III, both of which are supplied by Ciba Specialty Chemicals Corporation of Tarrytown, N.Y., as well as AlphaSan RC 5000, which is silver sodium hydrogen zirconium phosphate, supplied by Milliken Chemicals of Spartanburg, S.C. In accordance with the invention, any antimicrobial chemical may be used so long as it can be carried by a sizing mixture and can be incorporated within the interstices of the paper fibers following deposition of the sizing mixture along the paper web.

Turning once again to the paper manufacturing process, after passing the paper web through the sizing press, the paper web, now, of course, impregnated with the antimicrobial chemicals from the sizing mixture, is passed over a heated drying drum that evaporates the remaining water. The paper is then ready to be rolled up and delivered for production into paper sheets, forms, folders and the like, as is well known in the art.

It will thus be seen that the objects set forth above, among those made apparent from the preceding description, are efficiently attained and, since certain changes may be made in the processes and products described herein without departing from the spirit and scope of the invention, it is intended that all matter contained in the above description and shown in the accompanying drawings shall be incorporated as illustrative and not in a limiting sense.

It is also to be understood that the following claims are intended to cover all of the generic and the specific features of the invention herein described and all statements of the scope of the invention which, as a matter of language, might be said to fall therebetween.

What is claimed is:

1. An antimicrobial paper product comprising:

a paper web formed from a pulp slurry by water extraction and thereby defining paper fibers having a plurality of interstices;

a sizing mixture applied to said paper web;

wherein said sizing mixture includes water, a sizing material, and one or more antimicrobial chemicals such that the ratio of antimicrobial chemicals to sizing material in said mixture is from between about 0.1:100 and 1:100;

wherein said antimicrobial chemicals are inorganic antimicrobial agents selected from the group consisting of silver zeolites;

wherein said sizing material and said antimicrobial chemicals of said mixture are thus deposited along said paper web and thereby incorporated into said plurality of interstices;

wherein said paper product is produced following application of said sizing mixture and the subsequent drying of said paper web.

2. The paper product of claim 1, wherein said deposited sizing material from said applied sizing mixture is in an amount from between about 20 and 100 lbs. per ton of produced paper.

3. The paper product of claim 1, wherein said deposited antimicrobial chemicals are in an amount between about 0.02 and 1 pound per ton of produced paper.

4. The paper product of claim 1, wherein said sizing material is selected from the group consisting of soaps, animal glues, starch paste, synthetic glues, latex products and combinations thereof.

5. The paper product of claim 2, wherein said deposited antimicrobial chemicals are in an amount between about 0.02 and 1 pound per ton of produced paper.

6. An antimicrobial paper product comprising:

a paper web formed from a pulp slurry by water extraction and thereby defining paper fibers having a plurality of interstices;

a sizing mixture applied to said paper web;

wherein said sizing mixture includes water, a sizing material, and one or more inorganic antimicrobial agents selected from the group consisting of silver zeolites;

wherein said sizing material and said antimicrobial chemicals of said mixture are thus deposited along said paper web and thereby incorporated into said plurality of interstices;

wherein said paper product is produced following application of said sizing mixture and the subsequent drying of said paper web.

7. The paper product of claim 6, wherein said deposited sizing material from said applied sizing mixture is in an amount from between about 20 and 100 lbs. per ton of produced paper.

8. The paper product of claim 6, wherein the deposited antimicrobial agents are in an amount between about 0.02 and 1 pound per ton of produced paper.

9. The paper product of claim 6, wherein said sizing material is selected from the group consisting of soaps, animal glues, starch paste, synthetic glues, latex products and combinations thereof.

* * * * *